US005341633A

United States Patent [19]

Nishikawa et al.

[11] Patent Number: 5,341,633

[45] Date of Patent: Aug. 30, 1994

[54] APPARATUS FOR WINDING A ROVING APPLIED TO A ROVING FRAME

[75] Inventors: Hirotaka Nishikawa, Ichinomiya; Yoshio Kurachi, Nishikasugai; Takashi Kogiso, Mizunami; Shigeki Sekiya, Kuwana; Teruhiko Sato, Ama; Hideki Hashimoto, Kasugai; Makoto Ohmori, Tsushima; Kenji Sasaki, Komaki, all of Japan

[73] Assignee: Howa Machinery, Ltd., Nagoya, Japan

[21] Appl. No.: 984,278

[22] Filed: Dec. 1, 1992

Related U.S. Application Data

[63] Continuation of Ser. No. 545,613, Jun. 29, 1990, abandoned.

[30] Foreign Application Priority Data

Jun. 30, 1989 [JP] Japan ..... 1-170711

[51] Int. Cl.[5] ..... D01H 1/30; D01H 1/26

[52] U.S. Cl. ..... 57/264; 57/92; 57/93; 57/96; 57/97; 74/364

[58] Field of Search ..... 57/92, 93, 94, 95, 96, 57/97, 98, 100, 264, 265; 74/364

[56] References Cited

U.S. PATENT DOCUMENTS

| | | | |
|---|---|---|---|
| 2,277,198 | 3/1942 | Auer | 74/364 |
| 2,356,598 | 8/1944 | Lang et al. | 74/364 |
| 2,363,613 | 11/1944 | Olcott | 74/364 |
| 3,803,825 | 4/1974 | Einaudi | 57/278 |
| 4,196,572 | 4/1980 | Hunt | 57/96 |
| 4,254,615 | 3/1981 | Adolf et al. | 57/93 X |
| 4,375,744 | 3/1983 | Briner et al. | 57/96 |
| 4,467,593 | 8/1984 | Araki | 57/96 |
| 4,551,969 | 11/1985 | Kogiso et al. | 57/264 |
| 5,174,102 | 12/1992 | Matsui et al. | 57/264 |

FOREIGN PATENT DOCUMENTS

| | | | |
|---|---|---|---|
| 3713350 | 11/1987 | Fed. Rep. of Germany . | |
| 2621605 | 10/1987 | France . | |
| 52-13376 | 3/1977 | Japan . | |
| 52-48652 | 12/1977 | Japan . | |
| 63-264923 | 1/1988 | Japan . | |
| 327273 | 5/1969 | U.S.S.R. | 57/96 |
| 199221 | 6/1923 | United Kingdom | 57/92 |

*Primary Examiner*—Daniel P. Stodola
*Assistant Examiner*—William Stryjewski
*Attorney, Agent, or Firm*—Dennis H. Lambert

[57] ABSTRACT

In a roving winding apparatus applied to a roving frame provided with a plurality of draft parts and corresponding bobbin wheels, a bobbin shaft for driving the bobbin wheel, a bobbin rail on which the bobbin shaft is rotatably horizontally mounted along the longitudinal direction thereof, a lifting motion mechanism for lifting the bobbin rail, and a main motor for driving the draft parts at a predetermined rotational speed, wherein the bobbin shaft is driven under a controlled condition created by a servomotor to follow a digital signal output from the rotation angle detecting device applied to the common bottom front roller of the draft parts, in an adjusted optimal condition under the control of a computer system, incorporated with the lifting motion of the bobbin rail.

12 Claims, 8 Drawing Sheets

APPARATUS FOR WINDING A ROVING APPLIED TO A ROVING FRAME

This application is a continuation of application Ser. No. 07/545,613, filed Jun. 29, 1990 now abandoned.

BACKGROUND OF THE INVENTION

1. Field of the Invention

The present invention relates to an apparatus for winding a roving applied to each draft part of a roving frame, and more particularly, to an apparatus for winding a roving applied to each draft part of a roving frame of a bobbin lead winding system.

2. Description of the Related Arts

In the conventional roving frame, a roving delivered from each draft part is wound on a bobbin which is rotating at a predetermined higher speed than the rotational speed of a flyer, while providing twists on the roving. In this winding system, if the delivered length of the roving from the draft part per a unit of time does not match the winding length of the roving per the identical unit of time, in accordance with an increase of the diameter of a roving package formed on the bobbin, it is impossible to carry out a normal winding, and thus the winding tension of the roving is varied and breakages of the roving occur during the winding operation.

To solve the above problem, a cone drum type speed regulating device utilizing a pair of cone drums is commonly applied to a conventional roving frame. In this speed regulating device, the pair of cone drums comprises a driving cone drum and a driven cone drum, and the driven cone drum is driven by the driving cone drum through an endless belt which can be shifted along the axial direction of the cone drums. The shapes of these cone drums are designed to obtain the required regulation of the rotational speed of the bobbin relative to the constant rotational speed of the flyer, in accordance with an increase of the diameter of the package of each roving bobbin.

As mentioned above, in the cone drum type speed regulating device, the shape of the cone drums is designed so as to satisfy the predetermined spinning condition regarding the speed relationship between two cone drums, but the shape of the cone drums can be modified if a particular spinning condition is required. If a particular spinning condition is required, the displacement of the belt shifter is adjusted by a supplemental cam mechanism. Japanese Examined Utility Model Publication Showa 52 (1977)—13376, and Japanese Examined Patent Publication Showa 52 (1977)—48652 disclose the device mentioned above, but such a modified device has the disadvantages of a complicated operation when adjusting the device, the need for a relatively large space for the installation thereof, and a labor-consuming maintenance operation. Moreover, a complicated additional mechanism is needed to return the belt to a position for starting the winding operation.

To solve the above-mentioned problems, Japanese Unexamined Patent Publication Showa 63 (1988)—264923 provides a system utilizating a variable speed motor to drive bobbin wheels, i.e., a bobbin shaft, independently from the draft parts, wherein the driving speed of the bobbin shaft is controlled based upon a predetermined spinning condition. Namely, in this system, the variable speed motor is driven under variable conditions by means of an inverter, with suitable driving speeds of the bobbin shaft for forming particular portions of the roving bobbin being computed by a computer, based upon the delivery speed of a common bottom front roller of the draft parts and predetermined spinning conditions input to the computer. The speed of the variable speed motor is controlled in accordance with signals indicating changes in the direction of displacement of the bobbin rail. In this system, the above-mentioned cone drum speed regulating device can be omitted, thus removing the problems mentioned above. Nevertheless, since the rotation of the bobbin shaft is controlled in terms of the driving speed thereof, it is necessary to utilize a device to detect the delivery speed of the bottom front roller, and if the above-mentioned detector is an analog type unit, it is impossible to precisely control the driving speed of the bobbin shaft because the function of the detector is easily affected by changes of temperature, and if the above-mentioned speed detector is a digital type, it is impossible to precisely control the rotational speed of the bobbin shaft. Namely, if a digital type speed detector is utilized to detect the rotational speed of the bottom front roller, since the rotational speed of the bottom front roller is represented by the number of rotations of the bottom front roller per a unit of time, it is necessary to compute the rotational speed of the bottom front roller by a computer, and therefore, the above-mentioned computation must be carried out at each elapse of the above-mentioned unit of time, and thus the computed data can be obtained only at each elapse of the above-mentioned unit of time. In the above-mentioned case, the rotational speed, which is represented by analog data, of the variable speed motor is controlled by an inverter, and this control system is also affected by the temperature of a zone surrounding the control system. Further, if a commercially available inverter is utilized, the range of the control capacity of such an inverter is limited, and therefore, if it is necessary to control the variable speed motor within a range below the lower limit of the allowed frequency, the rotational speed of the variable speed motor cannot be maintained below the above-mentioned lower limit of the frequency. Accordingly, the response at the time of switching the roving frame and at the time of stopping the roving frame is not good.

SUMMARY OF THE INVENTION

To solve the above-mentioned problem, the apparatus for winding a roving applied to a roving frame, according to the present invention, is provided with a digitally controlled motor which is capable of changing the rotational angle of bobbins independently from the rotational angle of draft parts driven by a main motor. The apparatus includes a device for sensing the rotational angle of a common bottom front roller of drafting parts, as a digital value, an input means for inputting data needed for computing a winding diameter of a bobbin, at least a memory means for storing the data, a means for computing the winding diameter based upon the above-mentioned data, and a digitally controlled means for controlling the rotational angle of the above-mentioned digitally controlled motor to set the rotational angle of the bobbins so that it corresponds to the rotational angle of the front roller of the draft part. The winding diameter of the roving bobbin is computed based upon prestored data, and the rotational angle of the digitally controlled motor is controlled in accordance with the above-mentioned winding diameter so that a pertinent rotational angle of the roving bobbin, which corresponds to the rotational angle of the bottom front roller of the draft parts, is set. Accordingly, each bobbin wheel is driven with the rotational angle thereof in the condition according to the digital signal issued by the sensing device so that the roving delivered from the front rollers (top and bottom) can be properly wound onto the corresponding roving bobbin. As mentioned above, with a digital position control, whereby the rotational angle of the digitally controlled motor is controlled by digital pulses, the control system applied to the present invention does not suffer from possible adverse influences of variations of the temperature, variations of the voltage of the supplied electricity, and variations of the load, etc; and as no control elements related to "time" are used in this control system, a precise control obtained through a precise and good response can be carried out.

BRIEF DESCRIPTION OF THE DRAWINGS

The foregoing as well as other objects and advantages of the invention will become apparent from the following detailed description when considered with the accompanying drawings wherein like reference characters designate like parts throughout the several views, and wherein:

FIG. 4 is a sectional view of the gear change device, taken along line IV—IV in FIG. 3;

DETAILED DESCRIPTION OF THE PREFERRED EMBODIMENT

The function and the composition of the winding apparatus of a roving on a bobbin according to the present invention is hereinafter explained in detail, with reference to the preferred embodiments of the present invention.

Figure 1:
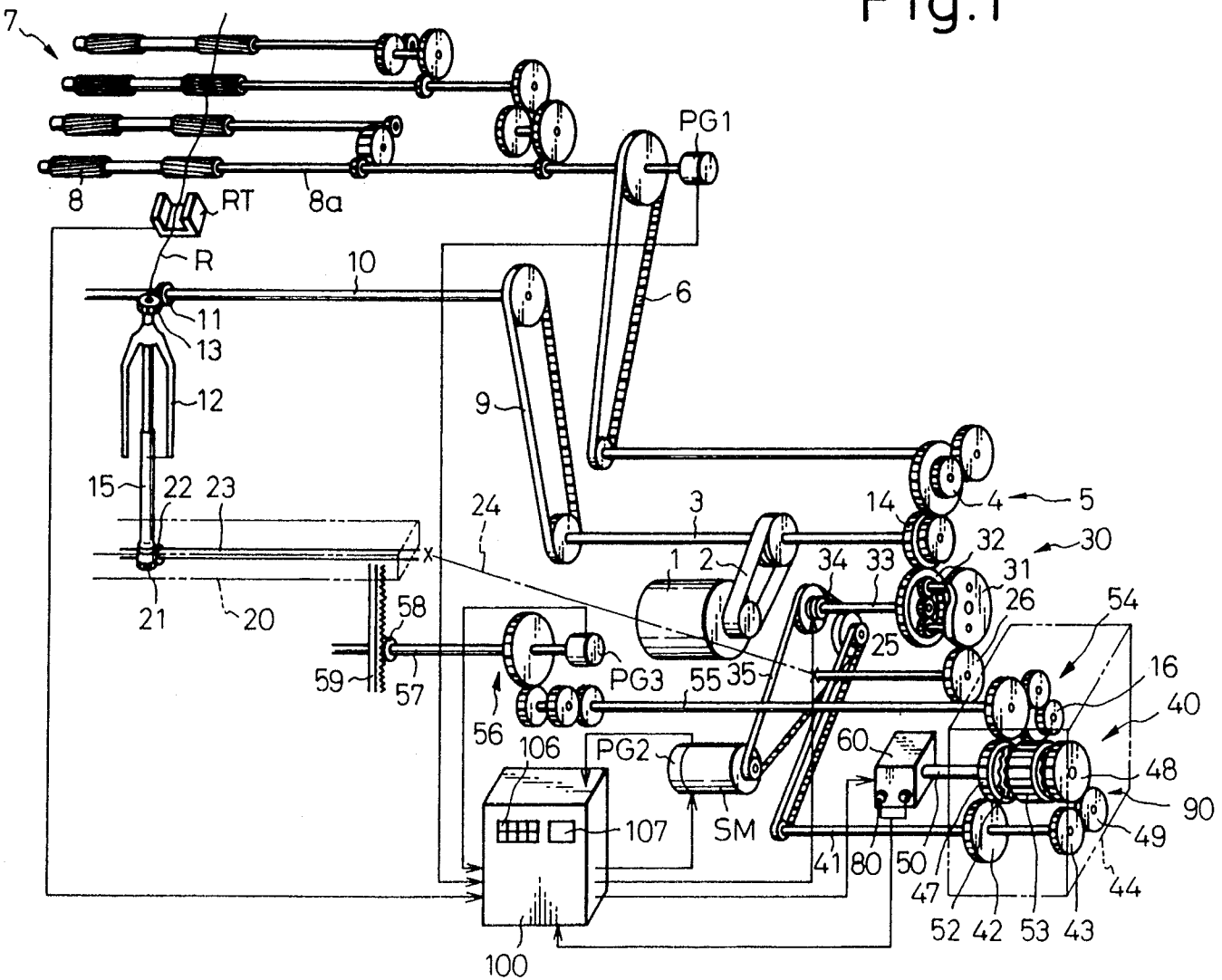
FIG. 1 is a general perspective view of the driving mechanism of the roving frame to which the present invention is applied.

Referring to FIG. 1, in the roving frame to which the present invention is applied, a driving shaft 3 is driven by a main motor 1 through a belt driven transmission mechanism 2, and the bottom front roller 8 of draft part 7 is driven by the driving shaft 3 through a gear train 5, including a twist change gear 4, and a belt driven transmission mechanism 6. On the other hand, a top shaft 10 is driven by the driving shaft 3 through a belt driven transmission mechanism 9. Each flyer 12 is driven at a constant rotational speed by meshing a drive gear 13 formed at the top end portion of each flyer 12 with a corresponding one of the drive gears 11 secured to the top shaft 10.

In each winding mechanism, a gear 22 is formed on a bobbin shaft 23 as one body and meshes with a bobbin wheel 21 rotatably mounted on a bobbin rail 20. The bobbin shaft 23 is connected to a connecting shaft 25 through a universal joint 24. A gear 26, which is formed on the connecting shaft 25 as one body, meshes with an output gear 31 of a differential gear mechanism 30, and an external gear 32 of the differential gear mechanism 30 meshes with a gear 14 formed at an end portion of the driving shaft 32.

One of the clutch plates of a magnetic clutch 34 is connected to an input shaft 33 of the differential gear mechanism 30 as one body, and the other of the clutch plates of the magnetic clutch 34 is able to be rotated by a belt driven transmission mechanism 35, in a position between the magnetic clutch 34 and a servomotor (digitally controlled servomotor) SM, which can independently control the rotational angle of the bobbin wheel 21 by the action of a control apparatus 100, as hereinafter explained in detail.

Accordingly, when the magnetic clutch 34 is connected, the constant speed driving motion of the driving shaft 3 is combined with the controlled rotation of the servomotor SM, by the differential gear mechanism 30, so that the bobbin wheel 21 is driven at a speed higher than the driving speed of the flyer 12, such that this higher rate corresponds to the control speed by the servomotor SM, so that the roving delivered from the front rollers of each draft part is correctly wound on a bobbin 15 mounted on the corresponding bobbin wheel 21.

Figure 2:
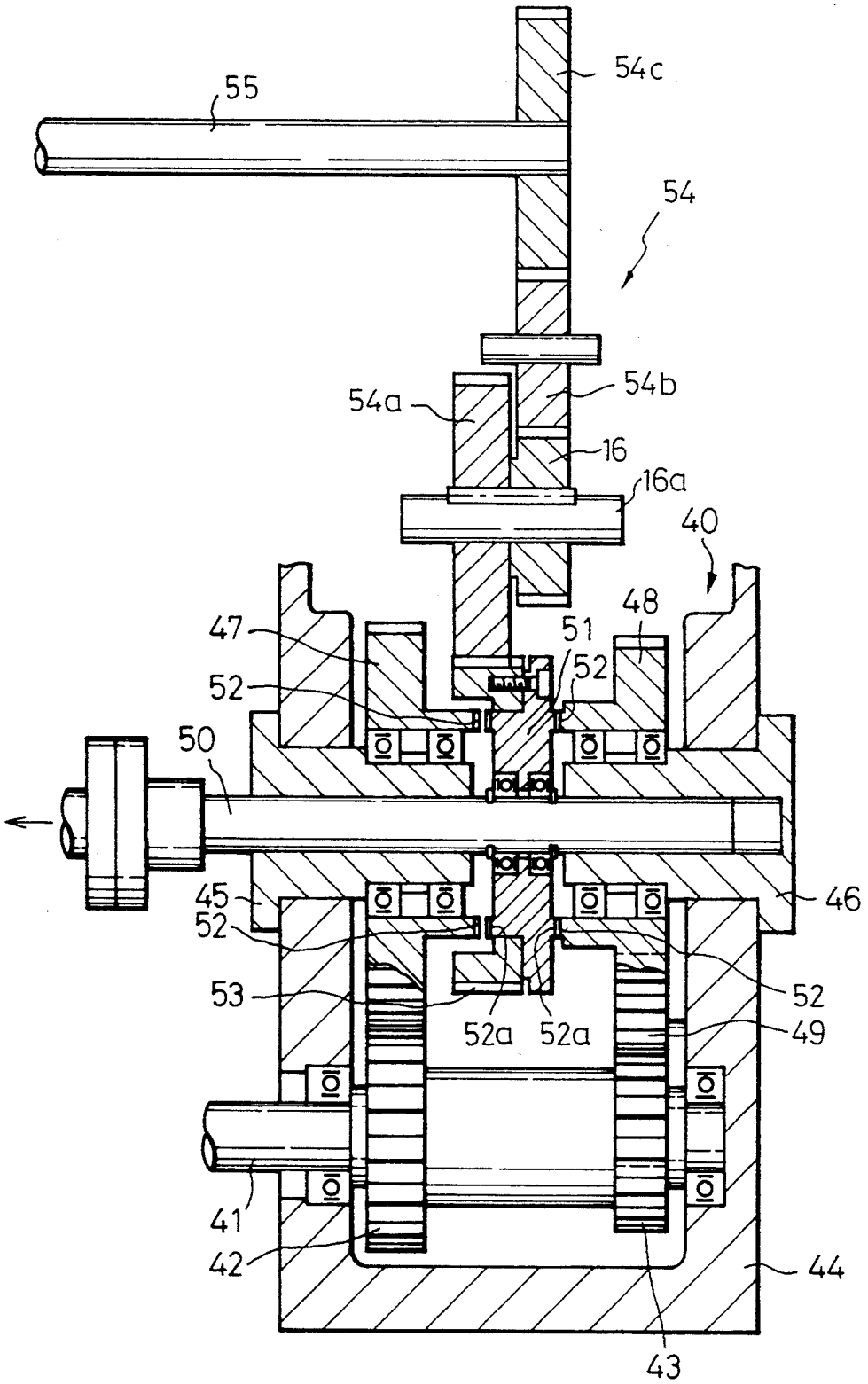
FIG. 2 is a sectional view of a change gear mechanism of the lifting motion of the roving frame shown in FIG. 1.

As shown in FIG. 2, a lifting change-over gear mechanism 40 of a bobbin rail lifting mechanism of the bobbin rail 20 is provided with a pair of drive gears 42, 43 in a gear box 44. These drive gears 42, 43 each are provided with a different number of teeth and are connected with the power transmission shaft 41 driven by the servomotor SM. A pair of supporting shafts 45, 46 are rigidly mounted on the gear box 44, and a change-over rod shaft 50 is slidably supported by the supporting shafts 45, 46 along the axial direction thereof. A pair of driven gears 47, 48 are rotatably mounted on the corresponding supporting shafts 45, 46, respectively, in the condition explained hereinafter. The gear 42, which is provided with a larger outer profile than the other gear 43, meshes with the driven gear 47, which is provided with a larger outer profile than the other gear 48, and the drive gear 43 drives the driven gear 48 through an intermediate gear 49 (FIG. 1).

A change-over wheel 51 is rotatably mounted on the change-over rod shaft 50 in a restricted condition such that the change-over wheel is displaced along the axial direction of the change-over rod shaft 50 when the rod shaft 50 is displaced along the axial direction thereof, and a pair of annular gears **52*a* are formed on both side surfaces of the change-over gear wheel 51 and the driven gears 47, 48 are provided with an annular gear 52 formed at the respective side surfaces thereof in a condition such that, when the change-over wheel 51 is moved toward the driven gear 47 by the displacement of the change-over rod shaft 50, the gear 52 of the driven gear 47 meshes with the gear 52*a* of the change-over wheel 51, and when the change-over wheel 51 is moved toward the driven gear 48 by the displacement of the change-over rod shaft 50, the gear 52** of the driven gear 48 meshes with the gear 52*a* of the change-over wheel 51. Since the annular gears 52*a* are formed at both side surfaces of the change-over wheel 51, the direction of the rotation of the change-over wheel 51 can be reversed by meshing the annular gear 52*a* with the annular gear 52 of the driven gear 47 or with the annular gear 52 of the driven gear 48.

A transmission gear 53 provided with a wider width of the gear teeth is formed on the peripheral surface of the change-over wheel 51, and coaxially therewith. The rotation of the change-over wheel 51 is transmitted to a pinion 58 mounted on a lifter shaft 57, through a gear train 54, a shaft 55, a gear train 56 and a shaft 57, in a normal direction and in a direction reverse to the normal direction, so that a lifter rack 59 rigidly mounted on the bobbin rail 20 can be displaced upward or downward. The gear train 54 is formed by a gear 54*a* rigidly mounted on a shaft 16*a* and meshed with the transmission gear 53*a*, a gear 16 rigidly mounted on the shaft 16*a*, an intermittent gear 54*b* meshed with the gear 16, and a gear 54*c* rigidly mounted on a shaft 55. The rotation of the shaft 55 is transmitted to the lifter shaft 57 through the gear train 56. In the above mechanism for transmitting the rotation of the change-over wheel 51 to the pinion 58, the upward or downward motion of the bobbin rail 20 is controlled by the rotational motion of the change-over wheel 51.

Figure 3:
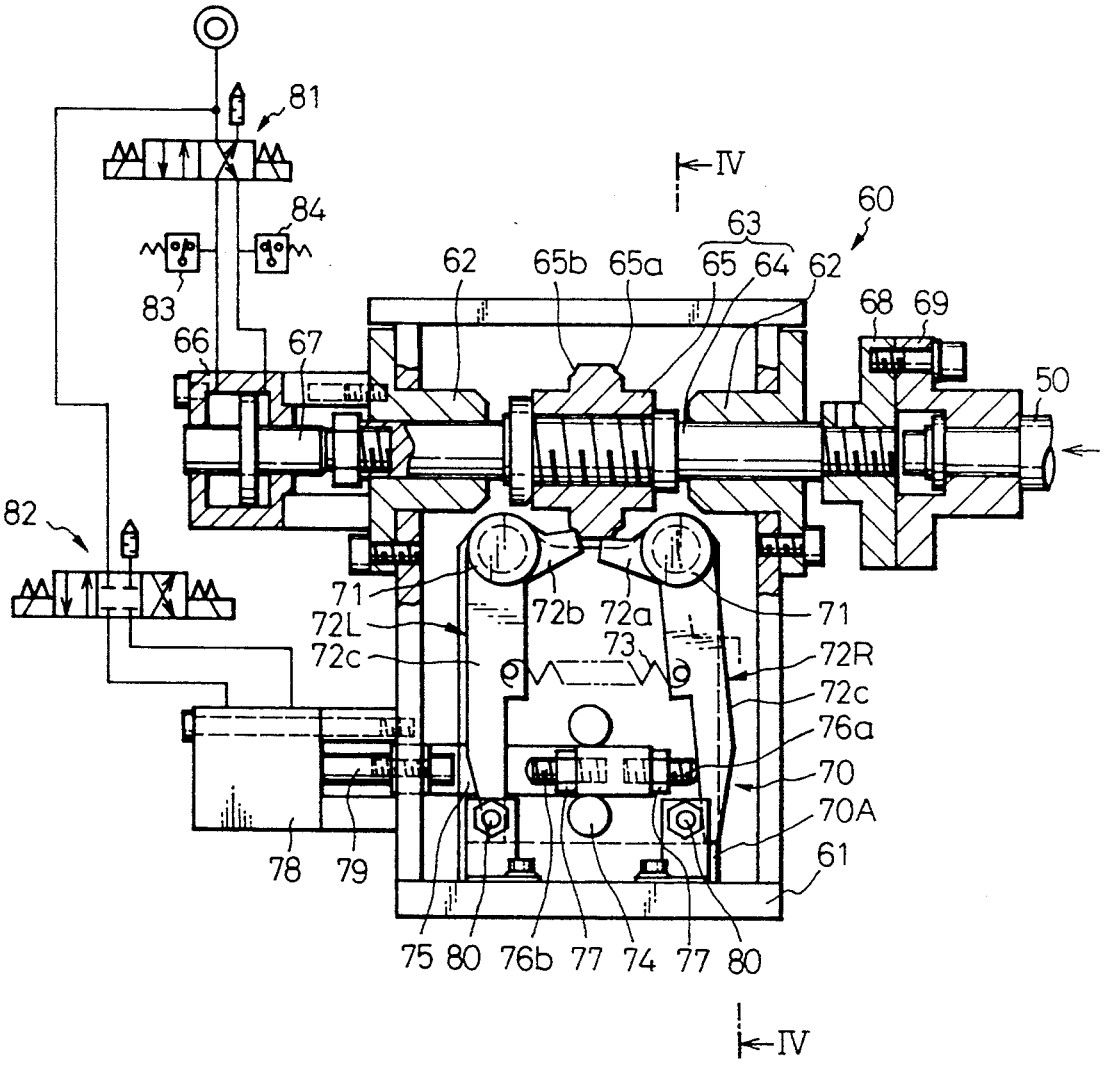
FIG. 3 is a side view of the gear change driving device according to the present invention.

Next, a change-over drive mechanism 60, which can be moved in both directions along the axial direction thereof, is shown in FIG. 3. This change-over drive mechanism 60 includes a pair of bushings 62 rigidly mounted on a box 61 in opposed relationship to each other. Change-over shaft 64 is slidably mounted on each bushing 62, and the change-over shaft 64 forms a change-over shaft body 63 together with an engaging body 65. One end portion of the change-over shaft 64, which is extended outside of the box 61, as shown in FIG. 3, is connected to a piston rod 67 of a pneumatic cylinder 66, which functions as an energizing means, mounted on a part of the machine frame. On the other hand, a flange body 68 is screw engaged to the other end portion of the change-over shaft 64. A flange body 69, which is rigidly mounted on an end portion of the change-over rod 50, is rigidly connected to the flange body 68 by screw fasteners extending in coaxial direction.

The engaging body 65, formed by a pair of engaging portions 65*a*, 65*b*, is rigidly mounted on a central portion of the change-over shaft 64, and an engagement change-over device 70 is arranged at a position downstream of the engaging body 65. In this engagement change-over device 70, a pair of engaging levers 72R, 72L are swingably supported in facing relationship to each other on an upper portion of corresponding L-shaped brackets 70A by a pair of pins 71. The engaging or catch levers 72R, 72L are provided with stoppers 72*a*, 72*b*, respectively, which are detachably engaged with the engaging elements 65*a*, 65*b*, respectively.

Figure 5:
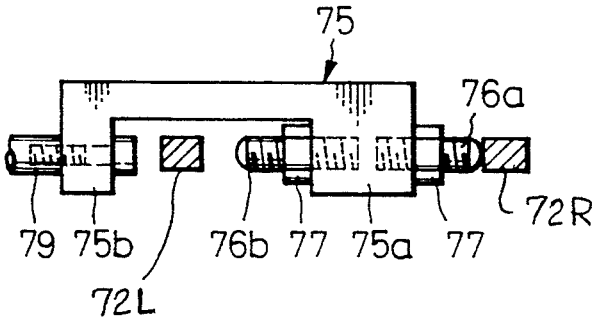
FIG. 5 is a plan view of a gear change operation rod according to the present invention.

A resilient spring 73 is disposed between a pair of pins formed at the respective intermediate positions of a pair of downwardly extended levers 72C, and a pair of rotatable guide rings 74, spaced downwardly from the spring 73, supported in predetermined spaced apart relationship to one another, and a change-over actuation rod 75 is guided into the space between the guide rings 74 (FIG. 3). The change over actuation rod 75 has a rectangular cross section, and a pair of press pins 76*a*, 76*b*, which are capable of pressing the corresponding engaging levers 72R, 72L, are adjustably mounted on both sides of a forwardly projected portion 75*a* of the rod 75, by respective nuts 77. A projected portion 75*b* of the change-over actuation rod 75 is rigidly connected to a piston rod 79 of a compressed air cylinder 78 (see FIGS. 3 and 5).

A limit switch 80 is disposed at a lower position of the box 61, so that when either of the stoppers 72*a* and 72*b* is engaged with the corresponding engaging portions 65*a* or 65*b* of the engaging body 65, a lower end portion of the lever 72*c* actuates the limit switch 80, which works to confirm the change-over of the lifting motion of the bobbin rail 20.

The above-mentioned cylinders 66 and 78 are connected to a compressed air supply source through change valves 81 and 82. Consequently, in the case that the bobbin rail 20 is displaced downward as shown in FIGS. 2 and 3, and then the above-mentioned downward motion of the bobbin rail 20 is changed to an upward motion, compressed air is reserved in a chamber at the front side (right hand side in FIG. 3), and the engagement of the engaging lever 72L with the engaging portion 65*b* is released by the change-over signal issued from a control apparatus 100 (FIG. 1), so that the change-over shaft 64 is displaced to the left in FIG. 3 by the resilient force of the above-mentioned compressed air. Accordingly, the change-over wheel 51 is meshed with the left side driven gear 47 through the change-over rod 50. In the reverse case, wherein the stopper 72*a* of the change-over drive mechanism 60 is engaged with the engaging portion 65*a*, and the left side driven gear 47 is meshed with the change-over wheel 51 in the lifting change-over gear mechanism 40, compressed air is reserved in the rear side chamber (left side) of the cylinder 66 to create a resilient force to the right in FIG. 3, and the engagement of the stopper 72*a* with the engaging portion 65*a* is released. In this embodiment, a lifting motion change-over means 90 comprises the lifting motion change-over gear mechanism 40 and the change-over drive mechanism 60. A pair of sensors 83 and 84 are utilized to confirm that compressed air is reserved in the chambers of the pneumatic or compressed air cylinder 66.

Next, the composition and function of the control system applied to the winding apparatus of roving according to the present invention is hereinafter explained in detail.

To attain the object of the present invention, a pulse encoder PG1 is rigidly connected to a shaft 8*a* of the bottom front roller 8. When the bottom front roller 8 turns by a predetermined rotation angle, a digital pulse is issued from the pulse encoder PG1. Therefore, it can be understood that one pulse represents the length of roving delivered from the front rollers of each draft part when the bottom front roller 8 turns through the above-mentioned rotation angle.

At an end portion of the lifter shaft 57 of the driving mechanism of the lifting change-over gear mechanism 40 and lifter rack 59 for lifting the bobbin rail 20, an absolute type pulse encoder PG3 is mounted to detect the rotation angle of the lifter shaft 57. The detected data of the encoder PG3 corresponds to the vertical position of the bobbin rail 20.

Non-contact type detectors for sensing the roving tension RT of a roving R are arranged between the bottom front roller 8 and a plurality of flyer tops. A tension detecting means such as the tension detector disclosed in U.S. Pat. No. 4,551,969, wherein a plurality of photo-electric sensing elements are arranged for a plurality of winding devices, can be utilized as the above-mentioned tension detector for the present invention.

The control apparatus 100 is constructed mainly by a known microcomputer 101. The microcomputer 101 is composed of a central processing unit CPU 102, a read only memory (ROM) 103 for storing a program shown in FIG. 7, and a random access memory (RAM) 104 for storing data and computed results. The CPU 102 receives data and outputs commands through input/output interface I/O 105. The I/O 105 is connected with an input means (keyboard) 106 which inputs various data, such as data required to compute the diameter of a roving bobbin, i.e., an initial diameter $d_o$ of a roving bobbin at the beginning of winding; a thickness $\Delta d$ in the radius direction of one layer wound around the roving bobbin ($\Delta d$ is a constant increment); a coefficient necessary for computing in the roving tension sensing device RT; data indicating the outer shape of the bobbin, for example, $\Theta 1$, $\Theta 2$, which are inclined angles of upper and lower shoulder portions (see B1 and B2 in FIG. 8) of the profile of the bobbin; an initial value of a frequency dividing ratio kp to be set, at the start of winding, to a frequency divider 109; and data specifying spinning conditions such as a roving count, number of twists, and textile material, etc. The above-mentioned I/O 105 is further input with data such as a detected roving tension signal output from the roving tension detecting device RT; the detected value signal output from the encoder PG3 and indicating the position of the bobbin rail 20; and the signal for confirming the change-over of the lifting motion of the bobbin rail 20, output from the confirmation switch 80 via a sequencer 108. The I/O 105 is further connected with display 107 indicating the contents of the above-mentioned inputs. On the other hand, a switching command for actuating the cylinder 78 of the change-over drive mechanism 60 is input via the sequencer 108, and is output from the I/O 105.

In the control apparatus 100, the frequency divider 109, to which the dividing ratio kp is to be set, is mounted and is connected to the CPU 102. The dividing ratio kp corresponds to a ratio of the rotation angle of a bobbin with respect to the rotation angle of the bottom front roller 8, to achieve an optimum winding of the roving delivered from the front rollers of a draft part on a bobbin, wherein the bobbin diameter D is increased one layer by one layer of roving. Therefore, a series of output pulses, which are created by the product of a series of pulses issued from the pulse encoder PG1 and to the dividing ratio kp [kp is less than 0.9999 and varied in accordance with an increase of the bobbin diameter D] is input to a servo-amplifier 111 for driving the servomotor SM, via a gate circuit 110.

The gate circuit 110 outputs forward or reverse pulses in accordance with the rotational direction of the pulse encoder PG1 during the usual winding operation, and when there is no input from the pulse encoder PG1 but the servomotor SM is to be driven, for example, when the bobbin rail 20 is only displaced downward for carrying out the doffing operation, after the full-packaged roving bobbins are produced and the roving frame is stopped, the servomotor SM is driven by the pulse produced by a pulse generator, contained in the circuit 110 in accordance with a command output from the sequencer 108.

A pulse-encoder PG2, which detects the rotation angle of the rotor shaft of the servomotor SM, is connected to the servomotor SM, and a position feed-back control system 112 is formed between the pulse encoder PG2 and the servo-amplifier 111, in which a feed-back pulse is transferred.

It can be understood from the following calculation that the above-mentioned dividing ratio kp becomes a function of the bobbin diameter D.

Since the product of the number of pulses due to the rotation of the bottom front roller 8 and the value kp equals the pulse number issued by the rotation of the servomotor SM, the following equation is introduced, $$kp=(\Theta s/\Theta r)\times(qs/qr) \quad (1)$$

where, $\Theta r$: rotation angle of the bottom front roller (rad), qr: number of pulses/one rotation of the encoder PG1 (constant value), $\Theta s$: rotation angle of the servomotor (rad) to the rotation angle $\Theta r$ of the bottom front roller, qs: number of pulses/one rotation of the encoder PG2 (constant value), On the other hand, the following equation (2) can be obtained, $$(\Theta B-\Theta F)\times D/2=\Theta r\times r \quad (2)$$

where, $\Theta F$: rotation angle of flyer (rad) to the rotation angle or of the bottom front roller r: radius of the bottom front roller (constant in a roving frame), $\Theta B$: rotation angle (rad) of a bobbin to the rotation angle $\Theta r$ of the bottom front roller, According to the construction of the differential gear mechanism 30, a constant A is set so as to satisfy the following equation;

$$\Theta B=\Theta F+A\times\Theta s \quad (3)$$

and the following equations (4) and (5) can be obtained from the equations (2) and (3)

$$\Theta r\times r/(D/2)=A\times\Theta s \quad (4)$$

then from the equations (4) and (1) can be obtained:

$$kp=r\times(qs/qr)/(A\times D/2)=f(D) \quad (5)$$

Regarding the relationship between the rotational angle $\Theta r$ and the displacement distance l of the bobbin rail 20, the following equation is obtained:

$$l=\Theta r\times r\times S/(2\times\pi\times D/2) \quad (6)$$

and from the equations (4) and (6) is obtained, $$l=A\times S\times\Theta s/(2\times\pi)=f(\Theta s) \quad (7)$$

As mentioned above, it is clear that the displacement distance of the bobbin rail 20 is a function of the rotation angle $\Theta s$ of the servomotor SM.

Figure 7:
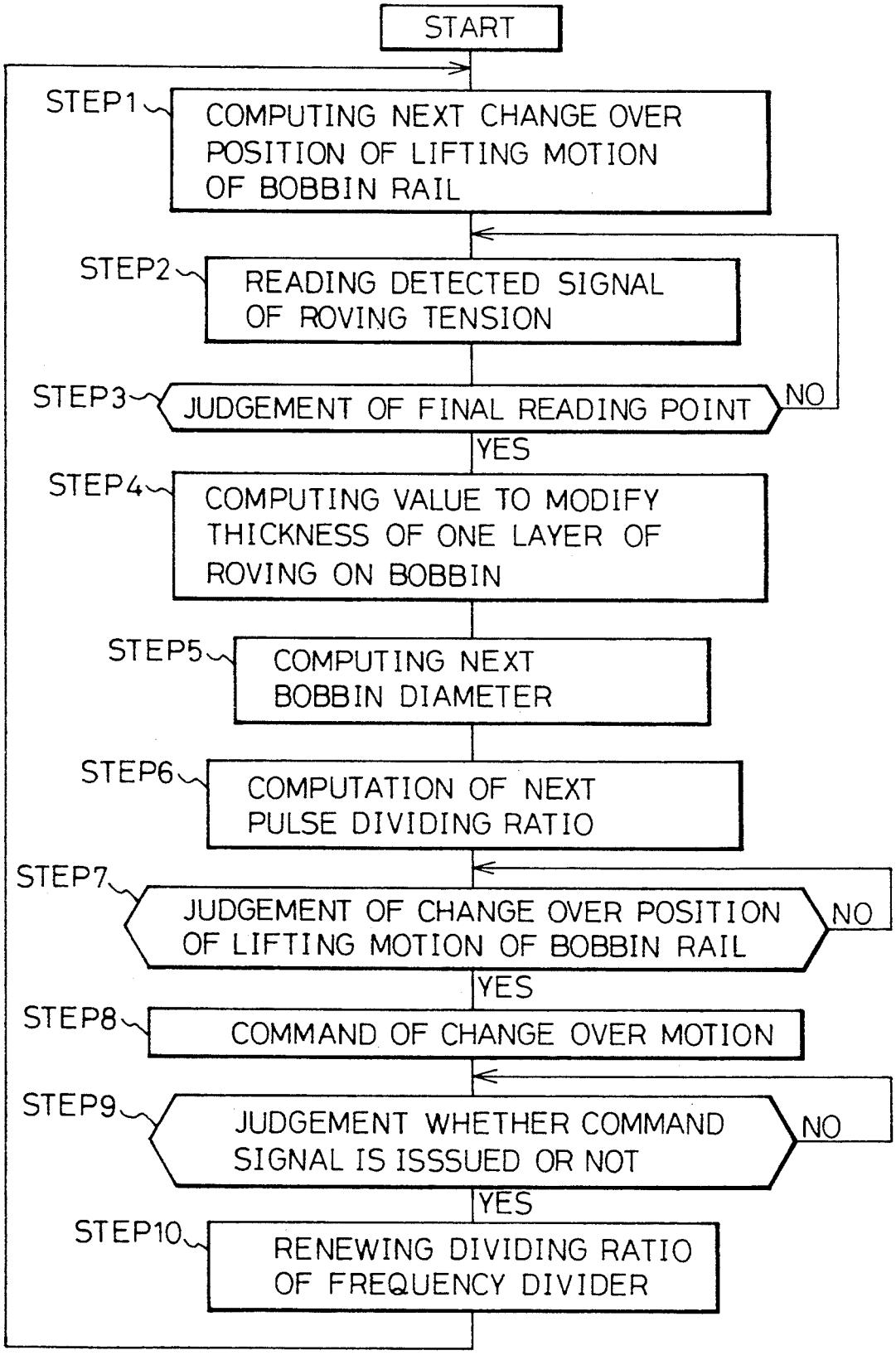
FIG. 7 is a flow chart of the control program according to the present invention.

Next, a control program related to the rotational speed of the bobbin and the change-over of the lifting motion of the bobbin rail 20, which are stored in the ROM 103, is explained with reference to the flow chart shown in FIG. 7.

Figure 8:
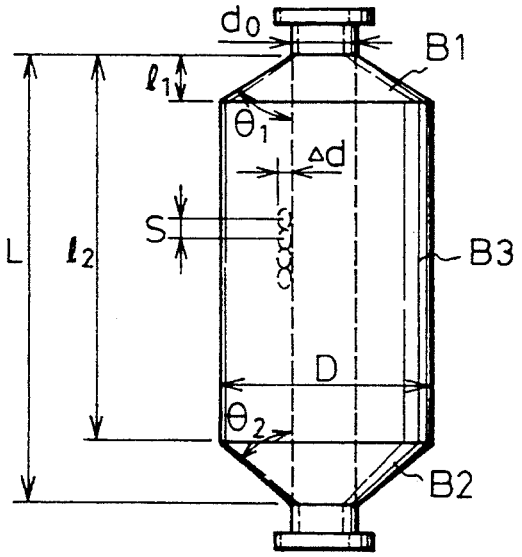
FIG. 8 is a schematic side view of a roving bobbin, for explaining the function of the present invention.
Figure 6:
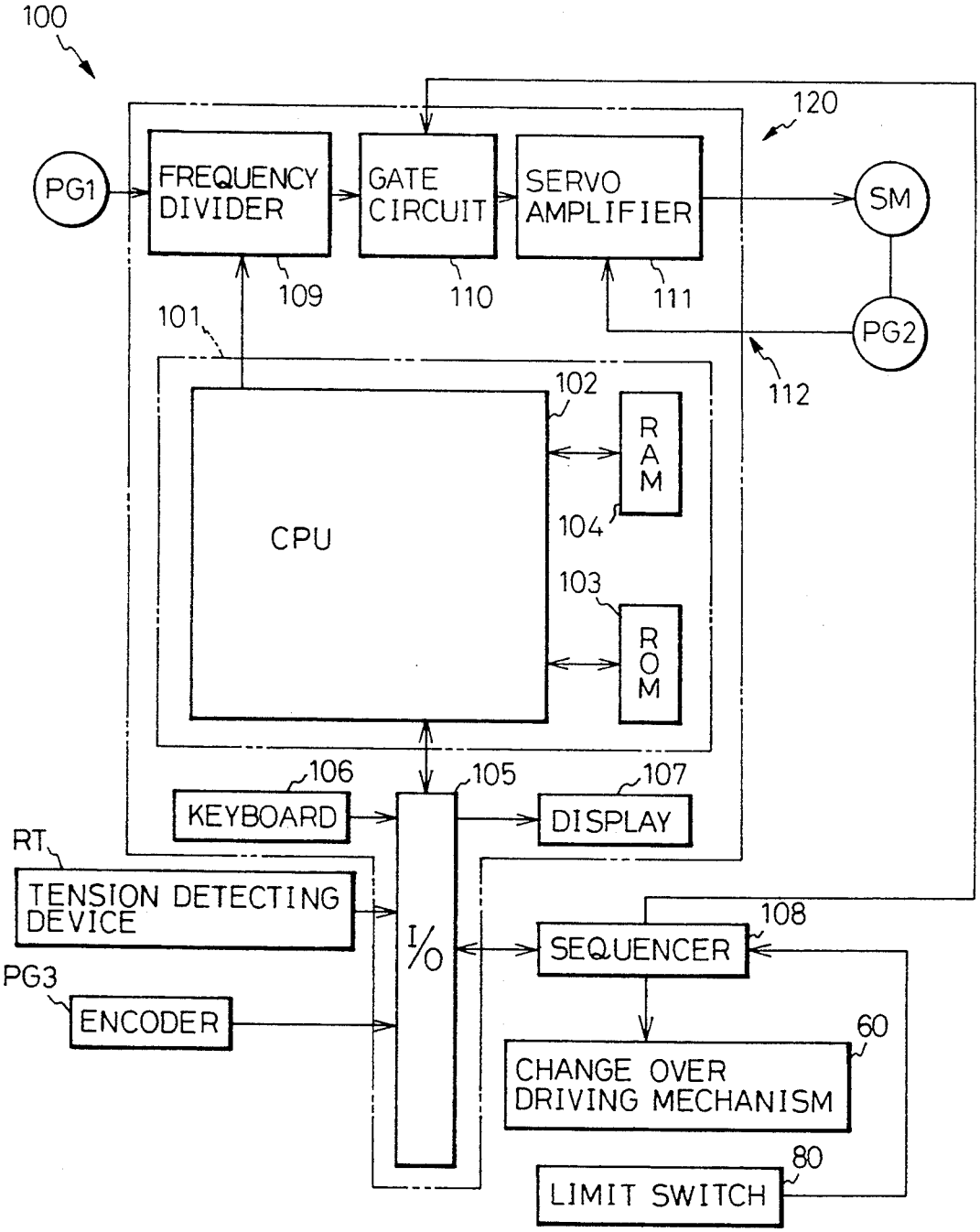
FIG. 6 is a genral block diagram of elements utilized for the control device according to the present invention.

As hereinafter explained, each step of the control program is equivalent to each functional means. That is, step 1 is a functional means for computing the top and bottom change-over positions $l_1$ and $l_2$ of the lifting motion of the bobbin rail 20 based on the following equations (8) and (9), $$l_2 = L - (D - do)/(2 \times \tan \Theta 2) \quad (8),$$

$$l_1 = (D - do)/(2 \times \tan \Theta 1) \quad (9),$$

wherein, at the change-over position $l_2$ of the bobbin rail 20, the forming of the bottom shoulder portion of the bobbin is started, while at the change-over position $l_1$ of the bobbin rail 20, the forming of the top shoulder portion of the bobbin is started, as shown in FIG. 8.

The rotation angles of the lifter shaft 57 are calculated from the data obtained from the above-mentioned equations.

In the normal spinning procedure, the winding of a roving onto a bare bobbin is started from the middle portion of the bobbin, and therefore, the winding of the roving is first displaced to the bottom end portion of the package formation and the lifting motion of the bobbin rail 20 is changed over at this bottom end portion to move upwards, the bobbin rail 20 is displaced to its uppermost position, and thereafter, the lifting motion of the bobbin rail 20 is carried out according to the control motion defined by the equations (8) and (9).

Step 2 is equivalent to a means for reading a detected signal of the roving tension. The roving tension is read several times during one stroke of displacing the bobbin rail to wind the roving on the bobbin between the upper shoulder B1 and the bottom shoulder B2 of the bobbin.

Step 3 is equivalent to a means for judging whether or not the reading point is the last, in creating a full packaged roving bobbin.

Step 4 is equivalent to a means for computing a value for modifying the thickness of one layer of roving on the bobbin, according to a detected tension of the roving, whereby $\epsilon$, which is a positive or negative modification value corresponding to the thickness gained by a one layer increase of the windings on the bobbin (a constant increment $\Delta d$), is computed by multiplying a coefficient to a difference between a predetermined expected value of the roving tension and the detected roving tension.

In step 5, the winding diameter D of the bobbin is computed by the following equation:

$$D \text{ (the bobbin diameter of next layer winding)} = D \text{ (the bobbin diameter of the present winding)} + 2 \times (\Delta d - \epsilon). \quad (10)$$

In step 6, the next frequency dividing ratio kp is computed by substituting the bobbin diameter D of a next layer winding with the above-mentioned equation (5).

Step 7 is equivalent to a means for comparing the detected value output from the encoder PG3 with the value computed by step 1 corresponding to the upper and bottom change-over positions $l_1$, $l_2$ of the bobbin rail 20.

Step 8 is equivalent to a means for outputting a command for the instruction of change-over of the lifting motion of the bobbin rail 20, to the sequencer 8, due to the result obtained by Step 7.

Step 9 is equivalent to a means for judging whether or not the signal for confirming the change-over has been output by the switch 80, to confirm the change-over of the lifting motion of the bobbin rail 20 in the change-over drive mechanism 60.

Step 10 is equivalent to a means for renewing the dividing ration by applying the dividing ration kp, computed in step 6, to the frequency divider 109.

The digital control means 120 is composed of means for carrying out the step 6 (means for computing the frequency dividing ratio), and means for carrying out the step 10 (means for renewing the dividing ratio), together with the divider 109, the gate circuit 110, the servo-amplifier 111, and the position feed back control system 112.

Next, the function of the roving winding device according to the present invention is hereinafter explained in detail.

OPERATION

During a one stroke operation wherein the bobbin rail 20 is displaced downward from the upper change-over position $l_2$ thereof to the lower change-over position $l_1$ thereof, the roving R is wound on the bobbin 15 from the lower shoulder portion B2 to the upper shoulder portion B1. The following explanation is directed to this one stroke operation. At this time, the dividing ratio kp computed to correspond with the new winding of the bobbin 15 is set to the frequency divider 109 by the CPU 102, and the output pulse obtained by the product of the pulse corresponding to a predetermined rotation angle of the bottom front roller 8 and the dividing ratio kp is input to the servo-amplifier 111 through the gate circuit 110. The servo-amplifier 111 rotates the servomotor SM for a predetermined angle, corresponding to the above-mentioned input pulse, and then the input shaft 33 of the differential gear mechanism 30 is driven by the rotation of the servomotor SM. Accordingly, the above-mentioned rotation of the input shaft 33 is combined with a constant rotation of the main motor 1, to rotate the bobbin wheel 21 driven by a predetermined rotation angle corresponding to the rotation angle $\Theta_r$ of the bottom front roller 8, to wind the roving on the bobbin in accordance with the diameter D of the bobbin 15, and the roving R delivered from the front rollers (bottom front roller 8 and a top front roller), by a rotation angle $\Theta_r$ of the bottom front roller 8, is correctly wound on the bobbin 15. At this time, since the rotation of the servomotor SM is controlled by the output pulse of the encoder PG1 connected to the bottom front roller 8, the response of this control motion is relatively fast. As mentioned above, when the bobbin rail 20 is displaced from the upper change-over position $l_2$ to the lower change-over position $l_1$, the roving R is wound on the bobbin from the lower shoulder portion to the upper shoulder portion. Further, as shown in FIG. 7, when the bobbin rail 20 is displaced downward, the next change-over position (in this case, the lower change-over position $l_1$) and the rotation angle of the lifter shaft 57 are computed, and the computed data is stored in the RAM 104. Then, in steps 2 and 3, the tension of the roving between the nip point of the front rollers and the corresponding flyer top is read from the roving tension detecting device, and in step 4, and a modification value $\epsilon$ related to a thickness increase $\Delta d$ (a constant increased thickness) is computed.

Next, the bobbin diameter D of the next layer winding after the change-over of the lifting motion of the bobbin rail 20 to the upward direction at the lower position $l_1$ is computed by the above-mentioned modification factor $\epsilon$ computed at step 4, and the present bobbin diameter D and the thickness increment Δd obtained by the equation (10). Then the next pulse dividing ratio kp is computed based upon the above-mentioned next bobbin diameter D in step 6, and this data is stored in the RAM 104. After the execution of step 6, if it is confirmed that the detected value corresponding to the position of the bobbin rail 20, which is output from the encoder PG3 in the step 7, coincides with the computed value corresponding to the lower change-over position $l_1$ of the lifting motion of the bobbin rail 20, which is stored in step 1, the command to actuate the change-over action of the lifting motion of the bobbin rail 20 is immediately output (steps 7 and 8).

When the bobbin rail 20 is displaced downward, since the lifting motion change-over gear mechanism 40 is in the condition as shown in FIG. 2, while the change-over drive mechanism 60 is in the condition shown in FIG. 3, compressed air is supplied into the front chamber of the cylinder 66, before the above-mentioned change-over signal is output, to energize the cylinder 66 to act for the change-over direction. When the change-over signal is output, the piston rod 79 of the cylinder 78 is displaced to the left in FIG. 3, according to the above-mentioned change-over signal received through the sequencer 108, and then the change-over actuation rod 75 moves to the left in FIG. 3 and the press pin **76*b* come into contact with the engaging lever 72L, so that the engagement of the stopper 72*b* with the engaging portion 65*b* is released. Accordingly, the piston rod 67 is instantly displaced to the left in FIG. 3 by a resilient spring-like action of the compressed air of the chamber of the cylinder 66 and the change-over wheel 51 is meshed with the driven gear at the left of FIG. 2 by the action of the change-over rod 50, so that the rotational direction of the driven shaft 55 is changed over,and thus the bobbin rail 20** is displaced upward.

When the engaging lever 72L is separated from the stopper **72*b* and the change-over shaft 64 is displaced to the left in FIG. 3, the stopper 72*a* for the engaging lever 72R is turned in the clockwise direction by the force of the spring 73, so that the stopper 72*a* is engaged with the engaging portion 65*a*. When the stopper 72*a* is engaged with the corresponding engaging portion 65*a*, or the stopper 72*b* is engaged with the corresponding engaging portion 65*b*, since the change-over shaft 64 cannot be displaced in the axial direction, even if a problem such as a stoppage of the electric supply occurs, the condition wherein the change-over wheel 51 is engaged with the driven gear 47 (48) can be maintained, and thus a possible dropping of the bobbin rail 20** is prevented.

When the engaging lever 72R at the right side in FIG. 3 is engaged with the change-over engaging portion **65*a*, the lifting motion change-over confirmation switch (limit switch) 80 confirms this engagement, and a confirmation signal is output to the interface I/O 105. Upon receiving this signal, the CPU 102 renews the dividing ratio kp of the divider 109** in step 10, through step 9, by the computed value obtained in step 6.

Step 1 to step 10 are then repeated so that the winding of the roving on the bobbin is completed. Nevertheless, since the stroke of the lifting motion of the bobbin rail 20 is gradually shortened in accordance with an increased diameter D of the bobbin, the upper and lower shoulder portions of the roving bobbin B1, and B2 are created in accordance with the input data. The change of the profile of the bobbin can be easily made by using only the input of the signal output from the Key board 106, and thus the above-mentioned operation requires less manpower.

When the roving R is wound on the bobbin and the full size roving bobbin is created, a signal is output to stop the winding motion, from the sequencer 108, and thus the main motor 1 is stopped together with the servomotor SM. Next, the change-over command signal is output from the sequencer 108 to the clutch 34, so that the clutch is actuated, and if the change-over wheel 51 of the lifting motion change-over gear mechanism 40 is meshed with the driven gear arranged at the side where the bobbin rail 20 is displaced upward by the normal rotation of the servomotor SM, the change-over wheel 51 is meshed with the driven gear 48 by the change-over drive mechanism 60. The above-mentioned condition of meshing the change-over wheel 51 with the driven gear 47 is confirmed by the signal produced from the change-over confirmation switch 80 applied to the bobbin rail 20. In this condition,a command signal for a normal rotation of the servomotor SM is issued from the sequencer 108 to the gate circuit 110, and the gate circuit 110 outputs a series of pulses for a normal rotation from a pulse generator contained therein and applies same to the servo-amplifier 111.

The servomotor SM is driven in the normal direction, to follow the above-mentioned series of pulses, and thus the bobbin rail 20 is displaced to a predetermined doffing position. Accordingly, the doffing operation of the full packaged roving bobbins is carried out and fresh bobbins are then mounted on the respective bobbin wheels. After the above-mentioned doffing and donning operation, the change-over wheel 51 is meshed with the driven gear 47 at the lifting upward side of the bobbin rail 20, and then the servomotor SM is driven in the normal direction, so that the bobbin rail 20 is moved upward to a predetermined position at which the winding operation is restarted. Thereafter, the main motor 1 is started and the roving bobbin forming operation is restarted.

In the above-mentioned embodiment, the winding diameter D of the bobbin 15 is computed by calculating the diameter D of bobbin 15 based upon the signal output by the roving yarn tension detecting device, but the following modification thereto can be made.

MODIFICATION ONE

Namely, in the case of a constant increase of the diameter of the roving bobbin 15 due to an increase of the number of layers of the roving on the bobbin 15, or if the profile of the cone drum mechanism is known, the above-mentioned equations and related data are stored in the computer, and thus the diameter D of the bobbin 15 can be computed. In this case, the device for sensing the roving tension can be omitted.

MODIFICATION TWO

In another modification of the above-mentioned embodiment, instead of utilizing the roving tension detected by the roving tension detecting device for computing the winding diameter D of the roving bobbin 15, it is possible to control the rotation of the servomotor SM to apply the following method whereby the bobbin diameter D is computed by utilizing an equation based upon the condition that the winding diameter D of the roving bobbin 15 is linearly increased by increasing one layer of the winding of roving on the bobbin, while the roving tension is adjusted to an allowable condition by detecting the roving tension by the roving tension detecting device.

In the first embodiment of the present invention, a clutch mechanism is arranged in the power transmission system, between the servomotor and the differential gear mechanism, and the bobbin rail is displaced upward or downward by driving the servomotor while the above-mentioned clutch is disengaged. Accordingly, it is not necessary to use a driving motor solely for the driving of the gear mechanism.

Figure 10:
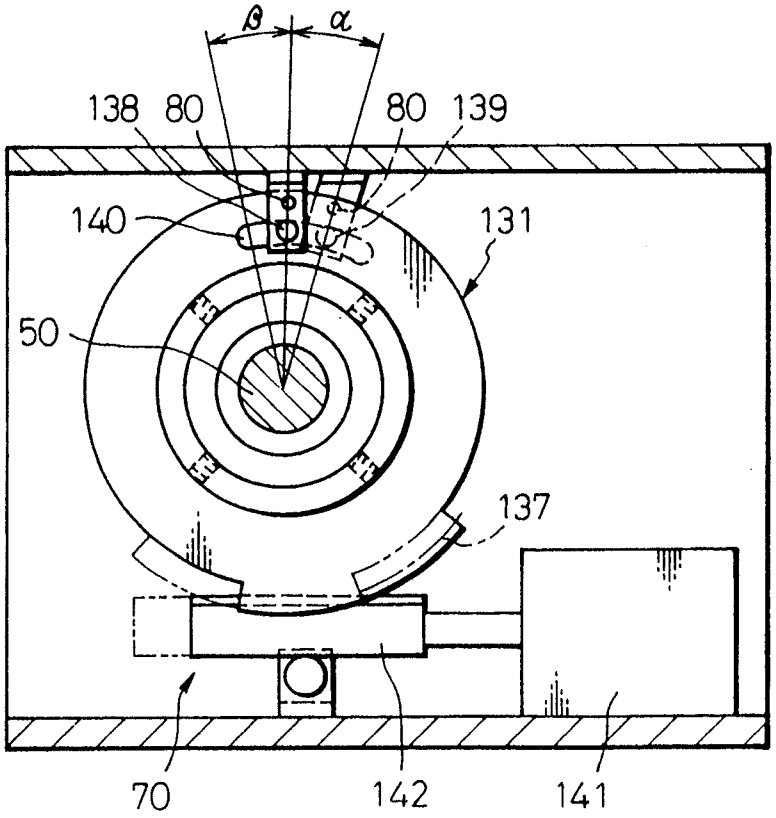
FIG. 10 is a sectional view of the driving change device, taken along line X—X in FIG. 9.
Figure 4:
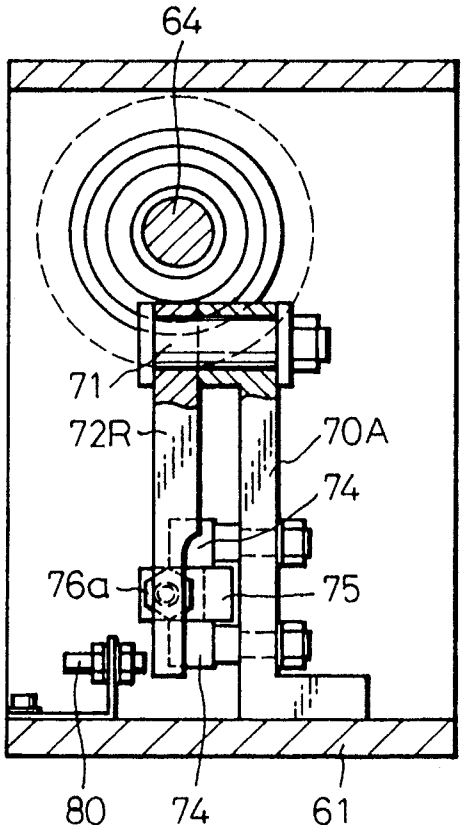
FIG. 4 is a sectional view of the gear change driving device shown in FIG. 3.

The second embodiment of the present invention is hereinafter explained with reference to FIGS. 9 and 10. In the following explanation, elements corresponding to those used in the first embodiment are identified by the same reference numerals as used in the first embodiment.

Figure 9:
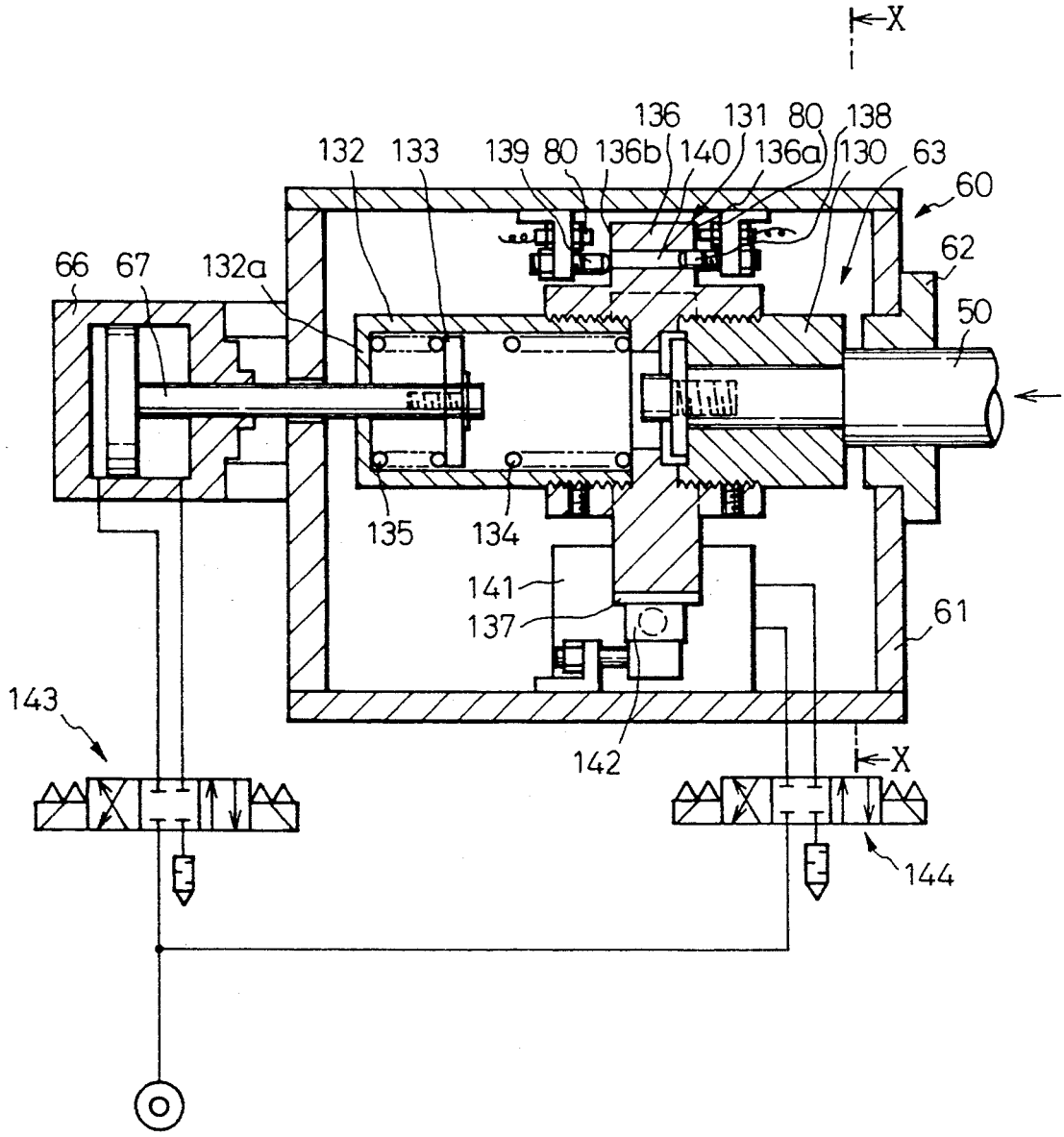
FIG. 9 is a sectional view of another embodiment of the driving change device according to the present invention.

In FIG. 9, the above-mentioned change-over rod shaft 50 is slidably and rotatably supported in the bearing bush 62 of the box 61, and is rigidly connected to a connecting cylinder 130. The connecting cylinder 130 is rigidly screw-connected to one side of an engaging body 131, and a cylindrical body 132 having one end thereof closed by a back side wall 132*a* is screw connected to the other side of the engaging body 131. A pressing ring 133, which is connected to the piston rod 67 of the pneumatic cylindrical body 66 secured to the box 61, is freely engaged in the cylinder 132. In this embodiment, the change-over shaft body 63 is constructed by the above-mentioned connecting cylinder 130, engaging body 131, and the cylinder 132. Resilient springs 134, 135 are arranged at corresponding positions between the pressing ring 133 and the engaging body 131, and between the pressing ring 133 and the backside wall 132*a* of the cylinder 132, respectively. The engaging body 131 has a laterally expanded portion 136 at the axially central portion thereof, and a sector gear 137 is formed at the bottom peripheral portion of the above-mentioned laterally expanded portion 136.

In the change-over drive mechanism 60, a pair of stoppers 138 and 139 are mounted on the box 61 with an angle $\alpha$ therebetween in the circumferential direction while sandwiching the above-mentioned laterally expanded portion 136. These stoppers 138 and 139 are engagable with the engaging portions 136*a* and 136*b*, respectively. The distance between the heads of the stoppers 138 and 139 in the axial direction in FIG. 9 is designed to satisfy the following condition. Namely, when the stopper 138 is engaged in an aperture 140, the driven gear 48 is meshed with the change-over wheel 51 so that the stopper 139 abuts against the engaging portion 136*b*, which is a left side portion of the laterally expanded portion 136 in the axial direction thereof, and when the stopper 139 is engaged in the aperture 140, the stopper 138 abuts against the engaging portion 136*a* which is a right side portion of the laterally expanded portion 136 in the axial direction thereof. In this case, the aperture 140 extends at an angle $\beta$ in the circumferential direction, which angle $\beta$ is larger than the angle $\alpha$, and thus both stoppers 138 and 139 can be alternately and instantaneously engaged with the aperture 140.

The above-mentioned change-over action of engaging the aperture 140 with the stoppers 138 or 139, is due to a swinging motion of the engaging body 131 with an angle of $\alpha+\beta$, which is created by meshing the sector gear 137 with a rack 142 which functions as the change-over actuation rod and is displaced forward and backward by the action of the compressed air cylinder 141.

Assuming that the change-over drive mechanism 60 is in the condition as shown in FIG. 9 and the lifting motion change-over gear mechanism 40 is in the condition as shown in FIG. 2, while the bobbin rail 20 is displacing downward, then in this condition, until the change-over signal indicating the lower change-over position is output, the piston rod 67 of the cylinder 66 is drawn therein to compress and energize the spring 135. When the change-over signal is output, the rack 142 connected to a compressed air cylinder 141 is displaced forward (displaced to the left in FIG. 10), the aperture 140 is swung by the angle $\alpha$ from the condition shown in FIG. 10, and the engagement of the stopper 139 with the engaging portion 136*b* is released so that the stopper 139 faces to the aperture 140. The engaging body 131 is then instantly displaced to the left in FIG. 10 by the resilient force of the spring 135, and therefore, the change-over rod 50 is also displaced to the left. Due to the above-mentioned motion of the change-over rod 50, the change-over wheel 51 shown in FIG. 2 meshes with the driven gear 47 arranged at the lifting side of the bobbin rail 20, so that the motion of the bobbin rail 20 is changed to the upward displacing motion. Then, by further turning the aperture 140 by the angle $\beta$, the stopper 138 is engaged with the engaging portion 136*a*. The change-over action of the lifting motion of the bobbin rail 20 from the upward displacing motion to the downward displacing motion is carried out while the spring 134 is compressed by the contact between the stopper 138 and the engaging portion 136*a*, and an action reverse to the above-mentioned action is carried out. The confirmation of the above-mentioned change-over motion is made by the lifting motion change-over confirmation switch (limit switch) 80, which faces the stoppers 138 and 139.

In this embodiment, the stoppers 138 (139) are engaged with the engaging body 136*a* (136*b*) after carrying out the change-over operation of the lifting motion of the bobbin rail 20, and accordingly, when the change-over operation is completed, the engaging body 131 cannot be displaced along the axial direction thereof, and thus the engaged condition of the change-over wheel 51 with the driven gear 47 (48) can be maintained.

As explained above, the digitally controlled motor is utilized in addition to the main motor for driving the draft parts. The rotational angle of the bottom front roller is also detected as a digital value, and a digital control is applied to control the rotational angle of the digitally controlled motor in such a manner that the rotational angle of the bobbin wheel corresponds to the digital pulse indicating the rotational angle of the bottom front roller, in accordance with the winding diameter D of the roving bobbin, while the above-mentioned winding diameter D of the roving bobbin is computed based upon the detected diameter of the roving. Therefore, it is possible to match the winding length of roving on the roving bobbin with the delivered length of the roving from the draft part, i.e., the delivered length of the roving from the nip point of the bottom front roller and the front top roller, and thus a correct and precise winding of the roving on the roving bobbin can be carried out without utilizing the known cone drum.

In the present invention, since the digital position control principle is applied, instead of utilizing the speed control principle, the time element influencing the response when the speed control principle is applied can be ignored, and thus a very good response can be attained in the present invention. Further, since the control system applied to the present invention is not adversely affected by, for example, changes in the room temperature, a precise control effect can be obtained. It is obvious that the spinning condition can be modified by simply inputting the necessary data, for computing the winding diameter of the roving bobbin, from the input means to the CPU.

Moreover, in the present invention, as shown in the second embodiment, the lifting motion of the bobbin rail is carried out by utilizing the digitally controlled motor, and two control motions, i.e., the changing of the rotational angle of the bobbin wheel and the change-over motion of the lifting motion of the bobbin rail, are carried out by this digitally controlled motor, and thus the construction of the winding mechanism applied for the roving frame can be simplified.

It can be further seen that the technical concept of the present invention can be applied to a roving frame provided with the change-over gear mechanism for the lifting motion of the bobbin rail wherein the conventional reversing bevel gear is utilized. Further, since in the present invention, before carrying out the change-over of the lifting motion of the bobbin rail, the energizing means for carrying out the change-over motion is previously energized so that the change-over rod can be instantly actuated by the previously energized means, and since the stopper is engaged with the engaging body after the completion of the change-over motion, even if a problem such as a stoppage of the supply of electric power occurs, the engagement of the stopper with the engaging body can be stably maintained, and thus a problem due to a sudden dropping of the bobbin rail due to a separation of the engagement of the change-over wheel can be prevented.

In the above-mentioned embodiment, the differential gear mechanism is arranged in the power transmission system which transmits the driving power of the main motor to the bobbin shaft, and the output of the servomotor is supplied to one of the input shafts of the differential gear mechanism. According to the technical concept of the present invention, however, it is also possible to modify the embodiment in a practical manner as follows. Namely, the output of the digitally controlled motor can be transmitted to the bobbin shaft without utilizing the differential gear mechanism, so that the rotation of the bobbin wheels follows the digital signals output by the control system mentioned in the above-mentioned embodiment. Such a modification can be applied easily in the textile engineering field, and therefore, a detailed explanation thereof is omitted.

While particular embodiments of the present invention have been shown and described for purposes of clarity and examples, many changes, substitutions and modifications to the described embodiment will be readily apparent to those possessed of ordinary skill in the art without thereby departing from the spirit and scope of the present invention which is defined and limited only by the following claims.

We claim:

1. A roving winding apparatus applied to a roving frame to produce roving bobbins, wherein the apparatus is provided with a plurality of draft parts and corresponding bobbin wheels, a bobbin shaft for driving said bobbin wheels, an elongated bobbin rail on which said bobbin shaft is rotatably mounted along the longitudinal direction thereof, a lifting motion mechanism for lifting said bobbin rail, a main driving motor for driving said draft parts at a predetermined rotational speed, said draft parts being provided with a common bottom front roller, and said lifting motion mechanism being provided with a mechanism for changing over a direction of displacement of said bobbin rail, comprising:

means for detecting a rotational angle of said bottom front roller and producing a digital signal representative of the rotational angle of said bottom front roller;

means for inputting data required to compute at least a diameter of said roving bobbin;

means for storing said data supplied from said input means;

means for computing the diameter of said roving bobbin based upon said stored data;

a digitally controlled motor for rotating the bobbin wheel, arranged independently from said main driving motor through said bobbin shaft; and digital control means for controlling a rotation angle of said digitally controlled motor based upon an output signal of said means for computing said diameter of the roving bobbin, in a relation with an output of said means for detecting said rotational angle of said bottom front roller;

whereby said digitally controlled motor rotates said bobbin wheel with said rotation angle computed by an output of said means for computing the diameter of said roving bobbin in relation to said digital signal of said sensing means, so that the balance between the winding length of said roving relying upon said rotation angle of said bobbin wheel on said roving bobbin and the delivery length of said roving relying upon said rotational angle of said bottom front roller is maintained.

2. A roving winding apparatus according to claim 1, wherein:

said bobbin rail lifting mechanism is provided with a lifter shaft for alternately displacing said bobbin rail upward and downward, said lifter shaft being driven by transmitting a rotation of said digitally controlled motor through said displacing direction change-over mechanism of said bobbin rail.

3. A roving winding apparatus according to claim 2, further comprising:

a differential gear mechanism capable of transmitting a rotation of said main motor to said bobbin shaft as a power transmission system, said differential gear mechanism being provided with an input shaft driven by said digitally controlled motor.

4. A roving winding apparatus according to claim 3, further comprising:

a clutch means arranged at a position between said digitally controlled motor and said input shaft of said differential gear mechanism.

5. A roving winding apparatus according to claim 2, wherein:

said change-over mechanism comprises a gear box, a pair of supporting shafts rigidly mounted on said gear box, a change-over rod shaft slidably supported by said supporting shafts along the axial direction thereof;

a change-over drive mechanism for actuating said change-over rod shaft;

a change-over wheel rotatably mounted on said change-over rod shaft in such a manner that a displacement thereof along the axial direction of said change-over rod shaft is restricted, said change-over wheel being provided with annular teeth at both sides thereof and further meshed with an intermediate gear for transmitting a driving power thereof to said lifting motion mechanism;

a pair of driven gears rotatably mounted on said change-over rod shaft at both sides of said change-over wheel, each of said driven gears being provided with an annular gear formed on a side thereof facing said change-over wheel while meshing with corresponding annular teeth of said change-over wheel;

a control shaft indirectly driven by said digitally controlled motor; and a pair of drive gears rigidly mounted on said control shaft and meshing with a corresponding one of said driven gears.

6. A roving winding apparatus according to claim 5, wherein:

said change-over drive mechanism is provided with an extended shaft connected to said change-over rod, as one body, and comprises a change-over shaft body provided with an engaging body having a pair of engaging portions formed axially on both sides thereof:

an energizing means for alternately energizing said change-over shaft body toward said change-over direction of said change-over wheel:

a pair of stoppers capable of alternately engaging a corresponding one of said engaging portions of said engaging body; and an engaging change-over device provided with a function of alternately engaging either one of said stoppers with a corresponding one of said engaging portions of said engaging body when the direction of lifting motion of said bobbin rail is to be changed.

7. A roving winding apparatus according to claim 6, wherein:

said energizing means is a compressed air cylinder provided with a cylindrical body and a piston rod axially movable in said cylindrical body, said piston rod being connected to said change-over shaft body.

8. A roving winding apparatus according to claim 6, wherein:

said energizing means has a compressed air cylinder rigidly mounted on a machine frame of said roving frame;

a piston rod axially movable in said cylinder; and a piston ring rigidly mounted on said piston rod in said cylinder, whereby said cylinder is divided into two chambers, and a pair of resilient springs disposed in a corresponding one of said chambers.

9. A roving winding apparatus according to claim 6, wherein:

said engaging change-over device comprises a pair of L-shaped engaging levers disposed in a swingable condition and each provided with a stopper capable of engaging with a corresponding one of said engaging portions of said change-over driving device;

a spring means for energizing said engaging levers toward respective directions for alternately engaging a corresponding one of said stoppers thereof with said engaging portions;

an actuation rod movable toward said swing directions of said engaging levers, said actuation rod being provided with a pair of press pins capable of alternately swinging a corresponding one of said stoppers toward a direction of disengagement from a corresponding one of said engaging portions by selectively coming into contact with a corresponding one of said engaging levers;

a compressed air cylinder for alternately moving said change-over actuation rod along the axial direction thereof; and a change-over valve for actuating said compressed air cylinder when said change-over motion of said device is required.

10. A roving winding apparatus according to claim 6, wherein:

said change-over drive mechanism is provided with an engaging body rotatably mounted on said change-over rod, said engaging body being provided with a pair of engaging portions and a sector gear formed at a peripheral surface thereof;

said change-over device being provided with a pair of stoppers rigidly mounted at positions sandwiching said engaging body and capable of engaging a corresponding one of said engaging portions, an aperture being formed in said engaging body at a position at which one of said stoppers is engagable therein by turning said engaging body in a corresponding direction;

a rack meshed with said sector gear;

a compressed air cylinder for alternately displacing said rack in both directions therealong; and a change-over valve for changing the actuation direction of said compressed air cylinder.

11. A roving winding apparatus according to claim 1, further comprising:

a differential gear mechanism capable of transmitting a rotation of said main motor to said bobbin shaft, said differential gear mechanism being provided with an input shaft driven by said digitally controlled motor.

12. A roving winding apparatus applied to a roving frame to produce roving bobbins, wherein the apparatus is provided with a plurality of draft parts and corresponding bobbin wheels, a bobbin shaft for driving said bobbin wheels, an elongated bobbin rail on which said bobbin shaft is rotatably mounted along the longitudinal direction thereof, a lifting motion mechanism for lifting said bobbin rail, a main motor for driving said draft parts at a predetermined rotational speed, said draft parts being provided with a common bottom front roller, and said lifting motion mechanism being provided with a change over mechanism for changing over a direction of displacement of said bobbin rail, comprising:

digital control means for producing a signal based on the combination of a sensed rotation angle of the bottom front roller and a computed diameter of the roving bobbin;

a digitally controlled motor for rotating the bobbin wheel, actuated by said signal issued from said digital control means and arranged independently from said main motor, said digitally controlled motor being actuated through a rotation angle for thereby rotating the bobbin wheel a predetermined rotation angle corresponding to the rotation angle of the bottom front roller and in accordance with the diameter of the roving bobbin, whereby the rotation angle of said bobbin wheel is controlled to a condition precisely corresponding to said rotation angle of said front roller so that the balance between the winding length of the roving on said roving bobbin and the delivery length of the roving is maintained;

said bobbin rail lifting mechanism including a lifter shaft for alternately displacing said bobbin rail upward and downward, said lifter shaft being driven by transmitting a rotation of said digitally controlled motor through said displacing direction change-over mechanism of said bobbin rail;

said change-over mechanism including a gear box, a pair of supporting shafts rigidly mounted on said gear box, a change-over rod shaft slidably supported by said supporting shafts along the axial direction thereof;

a change-over drive mechanism for actuating said change-over rod shaft;

a change-over wheel rotatably mounted on said change-over rod shaft in such a manner that a displacement thereof along the axial direction of said change-over rod shaft is restricted, said change-over wheel being provided with annular teeth at both sides thereof and further meshed with an intermediate gear for transmitting a driving power thereof to said lifting motion mechanism;

a pair of driven gears rotatably mounted on said pair of supporting shafts at both sides of said change-over wheel, each of said driven gears being provided with an annular gear formed on a side thereof facing said change-over wheel while meshing with corresponding annular teeth of said change-over wheel;

a control shaft indirectly driven by said digitally controlled motor; and a pair of drive gears rigidly mounted on said control shaft and meshing with a corresponding one of said driven gears.

* * * * *